US010808339B2

(12) United States Patent
Alexander et al.

(10) Patent No.: US 10,808,339 B2
(45) Date of Patent: Oct. 20, 2020

(54) KNITTED STRUCTURES FOR HEAT GENERATION AND DISTRIBUTION

(71) Applicant: GM Global Technology Operations LLC, Detroit, MI (US)

(72) Inventors: Paul W. Alexander, Ypsilanti, MI (US); Nancy L. Johnson, Northville, MI (US); Kuo-Huey Chen, Troy, MI (US); Nilesh D. Mankame, Ann Arbor, MI (US); Steven C. Lang, Columbus, MI (US); Michael S. Foos, Clarkston, MI (US); Suzanne M. Cody-Gump, Metamora, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 373 days.

(21) Appl. No.: 15/854,223

(22) Filed: Dec. 26, 2017

(65) Prior Publication Data

US 2019/0193660 A1 Jun. 27, 2019

(51) Int. Cl.

| | |
|---|---|
| ***D04B 1/04*** | (2006.01) |
| ***D04B 21/04*** | (2006.01) |
| ***D04B 1/18*** | (2006.01) |
| ***H05B 3/34*** | (2006.01) |
| ***D04B 1/12*** | (2006.01) |

(52) U.S. Cl.

CPC ..... *D04B 1/04* (2013.01); *D04B 1/12* (2013.01); *D04B 21/04* (2013.01); *H05B 3/345* (2013.01); *D04B 1/18* (2013.01); *D10B 2403/0243* (2013.01)

(58) Field of Classification Search

CPC ..... D04B 21/14; D04B 21/20

USPC ..... 442/308, 312, 313

See application file for complete search history.

(56) References Cited

U.S. PATENT DOCUMENTS

| | | | | |
|---|---|---|---|---|
| 5,021,281 | A | 6/1991 | Bompard et al. | |
| 5,858,159 | A | 1/1999 | Holbrook et al. | |
| 6,350,709 | B1 | 2/2002 | Veiga | |
| 6,808,587 | B2 | 10/2004 | Bohm et al. | |
| 8,362,882 | B2 | 1/2013 | Heubel et al. | |
| 8,371,339 | B2 * | 2/2013 | Li | D03D 11/00 139/383 R |
| 9,521,885 | B2 | 12/2016 | Weber et al. | |
| 2003/0101776 | A1 | 6/2003 | Shirasaki et al. | |
| 2010/0129575 | A1 | 5/2010 | Veiga | |

(Continued)

FOREIGN PATENT DOCUMENTS

CN 101640953 A * 2/2010

*Primary Examiner* — Jenna L Johnson

(74) *Attorney, Agent, or Firm* — Quinn IP Law

(57) ABSTRACT

A knitted structure is configured for heat generation and distribution. In some embodiments, the knitted structure includes a knitted fabric including a first knitted layer and a second knitted layer opposite the first knitted layer. The first knitted layer has a first thermal conductivity. The second knitted layer has a second thermal conductivity. The second thermal conductivity is greater than the first thermal conductivity to facilitate heat transfer toward the first knitted layer. The knitted structure may further include a plurality of electrodes at least partially disposed inside the knitted fabric. Each of the plurality of electrodes is configured to generate heat within the knitted fabric upon receipt of electrical energy in order to distribute heat along the knitted structure and toward the first knitted layer.

7 Claims, 7 Drawing Sheets

(56) References Cited

U.S. PATENT DOCUMENTS

| | | | |
|---|---|---|---|
| 2011/0062134 | A1 | 3/2011 | Lochtman et al. |
| 2012/0280479 | A1 | 11/2012 | Barth et al. |
| 2014/0001814 | A1 | 1/2014 | Fujita et al. |
| 2016/0303799 | A1 | 10/2016 | Pettey et al. |
| 2017/0249033 | A1 | 8/2017 | Podhajny et al. |

* cited by examiner

KNITTED STRUCTURES FOR HEAT GENERATION AND DISTRIBUTION

INTRODUCTION

The present disclosure relates to knitted structures for heat generation and distribution.

In some applications, it is desirable to distribute heat through a knitted structure. For example, a vehicle seat may include knitted textile that may require heating. For this reason, it is desirable to develop a knitted structure capable of generating and distributing heat.

SUMMARY

A knitted structure is configured for heat generation and distribution. In some embodiments, the knitted structure includes a knitted fabric including a first knitted layer and a second knitted layer opposite the first knitted layer. The first knitted layer has a first thermal conductivity. The second knitted layer has a second thermal conductivity. The second thermal conductivity is greater than the first thermal conductivity to facilitate heat transfer toward the first knitted layer. The knitted structure may further include a plurality of electrodes at least partially disposed inside the knitted fabric. Each of the plurality of electrodes is configured to generate heat within the knitted fabric upon receipt of electrical energy in order to distribute heat along the knitted structure and toward the first knitted layer. The second knitted layer may include a plurality of heat-insulating yarns. The second knitted layer may include a plurality of infrared reflective yarns. The knitted structure may further include a middle knitted layer disposed between the first knitted layer and the second knitted layer. The middle knitted layer may include a plurality of resistive heating yarns to facilitate heat transfer toward the first knitted layer. The middle knitted layer may include a plurality of infrared producing yarns to facilitate heat transfer toward the first knitted layer. The first knitted layer may include plurality of infrared transparent yarns to provide a heated surface. The first knitted layer may include a plurality of infrared transparent yarns to provide a purely radiative heating surface. The first knitted layer may include a plurality of infrared transparent yarns and a plurality of infrared absorbing yarns by defining a porosity on the first knitted layer. The knitted structure may define a gap between the first knitted layer and the second knitted layer to allow air flow through the gap. The second knitted layer may include a plurality of heat-insulating yarns to facilitate heat transfer toward the first knitted layer. The knitted structure may further include a middle knitted layer disposed between the first knitted layer and the second knitted layer. The middle knitted layer may include a plurality of resistive heating yarns to facilitate heat transfer toward the first knitted layer. The first knitted layer may include plurality of infrared absorbing yarns to provide a heated surface. The first knitted layer includes a plurality of infrared transparent yarns to provide a radiative heating surface.

In some embodiments, the knitted structure includes a first knitted layer, a second knitted layer, and a knitted spacer fabric interconnecting the first knitted layer and the second knitted layer. Further, the knitted structure includes a thermoelectric device (TE) disposed inside the knitted structure. The knitted structure defines a pocket sized to receive the thermoelectric device. The thermoelectric device is closer to the second knitted layer than to the first knitted layer. The thermoelectric device is configured to convert electrical energy directly a temperature differential for heating or cooling. The knitted spacer fabric includes a heat-conductive yarn network directly interconnecting the pocket and the first knitted layer to transfer heat from the thermoelectric device to the first knitted layer. A similar thermally conductive network may be knitted into the second knitted layer to service the opposite side of the thermoelectric device, so each side of the TE device has an efficient heat sink structure. The knitted structure may further include at least one power lead disposed inside the second knitted layer and electrically connected to the thermoelectric device to supply electricity to the thermoelectric device. The pocket is partly defined by the second knitted layer. The knitted structure further includes an overlying knitted layer directly connected to the second knitted layer to form the pocket. The thermoelectric device can also be run in an opposite mode, cooling the first knitted layer while heating the second knitted layer.

In some embodiments, the knitted structure includes a knitted body including a first knitted layer and a second knitted layer. The knitted body defines a duct between the first knitted layer and the second knitted layer to allow fluid flow through the knitted body. The knitted body is configured to be flat for shipping. The knitted body includes fusible yarns to allow expansion for assembly. The knitted structure may further include a knitted spacer fabric between the first knitted layer and the second knitted layer.

The above features and advantages and other features and advantages of the present teachings are readily apparent from the following detailed description of the best modes for carrying out the teachings when taken in connection with the accompanying drawings.

DETAILED DESCRIPTION

Figure 1:
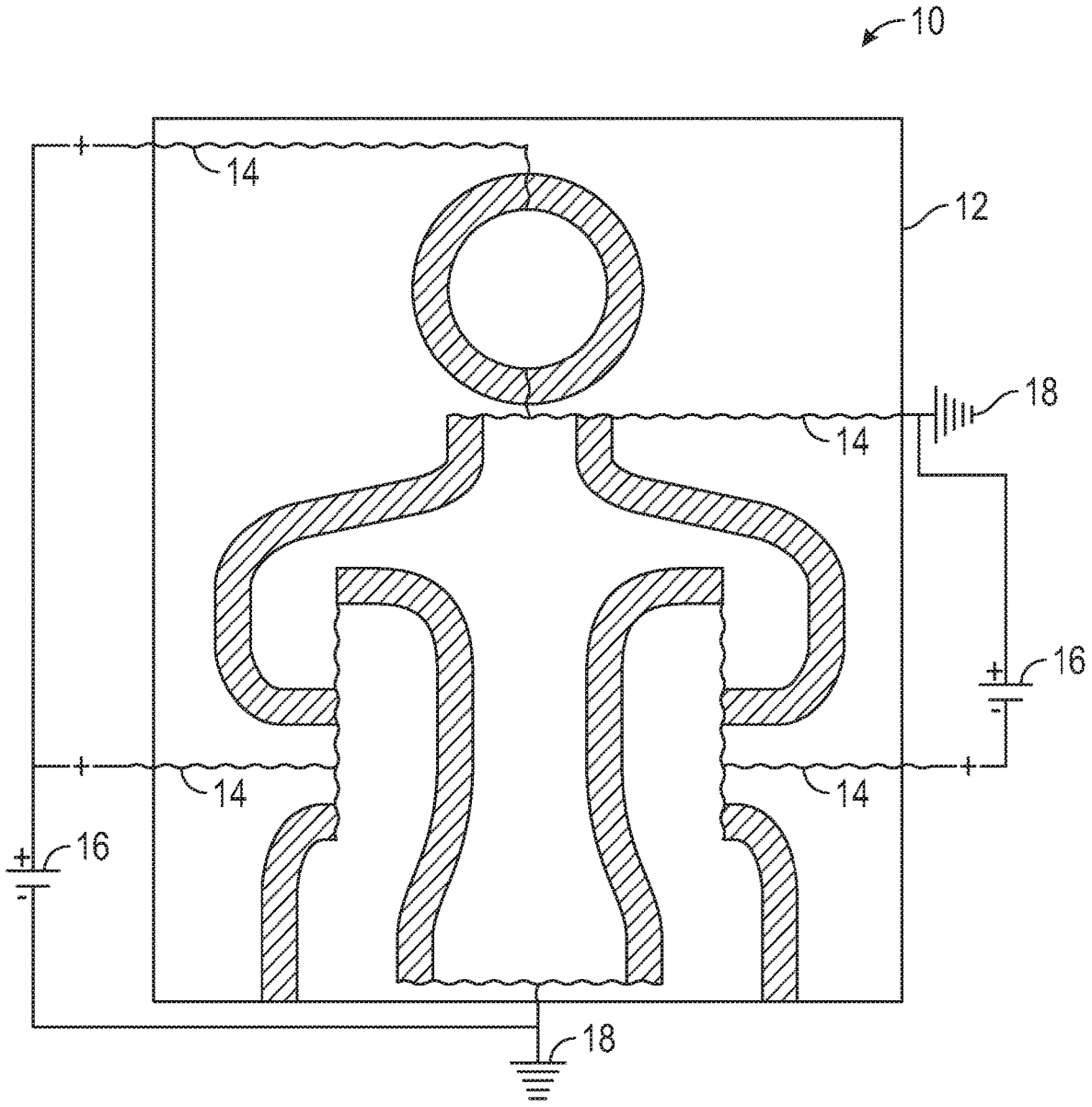
FIG. 1 is a schematic sectional view of a knitted structure for heat generation and distribution.

Referring to the drawings, wherein like reference numbers correspond to like or similar components throughout the several figures, and beginning with FIG. 1, a knitted structure 10 can be used for heat generation and distribution. In the present disclosure, the term "knitted" does not include woven materials; rather, the term "knitted" refers to textiles that result from knitting. As non-limiting examples, the knitted structure 10 may be the packaging of a heating ventilation and air conditioning (HVAC) system in order to provide efficient heat transfer. It is envisioned, however, that the knitted structure 10 can be used to efficiently transfer heat toward a desired surface. For example, the knitted structure 10 may be a seat, such as a vehicle seat, that can efficiently transfer heat toward a heated surface in order to provide heat to a seated occupant during cold climates. The knitted structure 10 includes a knitted fabric 12 and a plurality of electrodes 14 at least partially disposed inside the knitted fabric 12. For example, the electrodes 14 can be knitted and/or inlayed within the knitted fabric 12. The electrodes 14 are configured to receive electrical energy from one or more electrical power supplies 16, which may be considered part of the knitted structure 10. As non-limiting examples, the electrical power supplies 16 are configured as one or more battery cells. The electrodes 14 are electrically connected to the electrical power supplies 16 and ground 18. Therefore, the electrodes 14 can receive electrical energy from the electrical power supplies 16. Upon receipt of electrical energy from the electrical power supplies 16, the electrodes 14 are configured to generate heat within the knitted fabric 12 to distribute heat along the knitted structure 10. In the depicted embodiment, the electrodes 14 are solely disposed inside some (not all) parts of the knitted fabric 12 to generate and distribute heat along targeted locations of a patterned electrical power delivery arrangement. It is envisioned, however, that the electrodes 14 can be positioned to distribute heat along the entire knitted structure 10. The knitted structure 10 can be used for electrical heating and/or seat warming. It is also envisioned that the knitted structure 10 could be used to direct heat to specific areas to defog windows.

Figure 2:
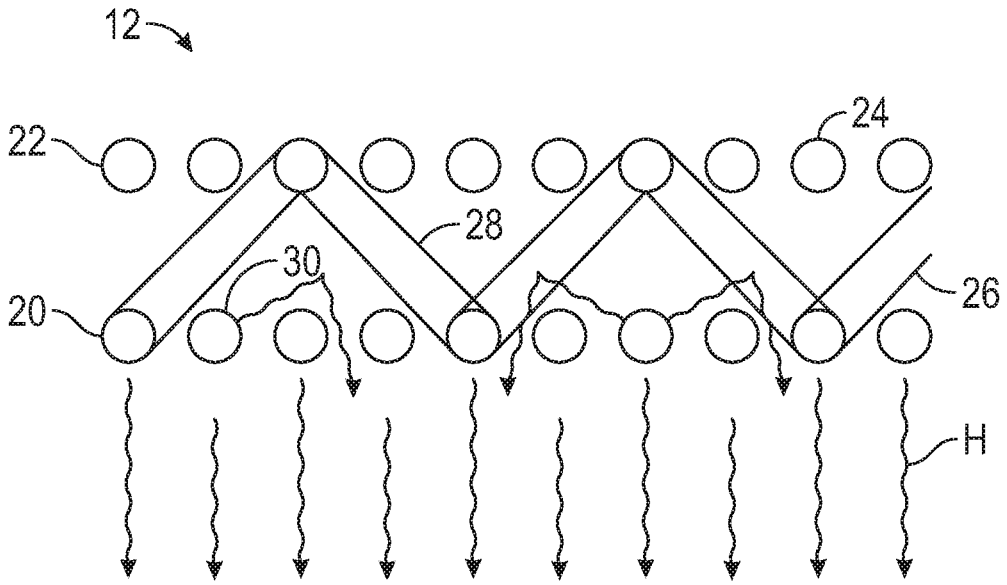
FIG. 2 is a schematic fragmentary cross-sectional view of the knitted structure shown in FIG. 1.

With reference to FIG. 2, the knitted fabric 12 includes a first knitted layer 20 and a second knitted layer 22 that is opposite the first knitted layer 20. The first knitted layer 20 may be made of polyester and has a first thermal conductivity. The second knitted layer 22 has a second thermal conductivity, which is greater than the first thermal conductivity to facilitate heat transfer toward the first knitted layer 20. As discussed above, the electrodes 14 are disposed inside the knitted fabric 12 and can therefore generate heat within the knitted fabric 12 to distribute the heat long the knitted fabric 12 toward the first knitted layer 20. It is desirable to distribute heat toward the first knitted layer 20 to, for example, provide comfort to a seated occupant of the vehicle seat (i.e., the knitted structure 10). Alternatively, it is desirable to distribute heat toward the first knitted layer 20 to, for example, provide an energy efficient packaging for a HVAC system (i.e., the knitted structure 10).

With continuing reference to FIG. 2, to facilitate distribution of heat toward the first knitted layer 20, the second knitted layer 22 includes a plurality of heat-insulating yarns and/or infrared reflective yarns (i.e., the second layer yarns 24). In the present disclosure, the term "heat-insulating yarns" means yarns which are mostly made of a thermally-insulating material. As a non-limiting example, the heat-insulating yarns may be wholly or partly made of polyoxadiazole fibers to provide optimum thermal resistance. In the present disclosure, the term "infrared reflective yarns" means yarns that are capable of reflecting infrared radiation to impede heat transfer. To do so, the fibers forming the infrared reflective yarns may be coated with an infrared reflective coating. As a non-limiting example, the polymeric fibers forming the infrared reflective yarns may be coated with a metallic coating (e.g., aluminum coating) to provide infrared radiation reflection. Additionally or alternatively, polymeric fibers forming the infrared reflective yarns may be coated with infrared reflective pigments.

With continuing reference to FIG. 2, the knitted fabric 12 further includes a middle knitted layer 26 disposed between the first knitted layer 20 and the second knitted layer 22. In the depicted embodiment, the middle knitted layer 26 directly interconnects the first knitted layer 20 and the second knitted layer 22 to facilitate heat transfer toward the first knitted layer 20. The middle knitted layer 26 includes a plurality of resistive heating yarns and/or infrared producing yarns (i.e., the middle layer yarns 28) to facilitate heat transfer toward the first knitted layer 20. In the present disclosure, the term "resistive heating yarns" means yarns that are capable of converting all or at least most of the electrical energy received by the yarns into heat. Therefore, the resistive heating yarns are capable of absorbing heat. As a non-limiting example, the resistive heating yarns include, but are not limited to, silver-coated polyimide yarns. In the present disclosure, the term "infrared producing yarns" means yarns that are capable of absorbing heat from the electrodes 14 and emanating infrared radiation. For this reason, the middle layer yarns 28 may be in thermal communication (e.g., direct contact) with the electrodes 14. As a non-limited example, the infrared producing yarns may be wholly or partly made of polyamide 6.6 yarn.

With continuing reference to FIG. 2, the first knitted layer 20 includes a plurality of infrared transparent yarns and/or infrared absorbing yarns (i.e., the middle layer yarns 28) to emanate heat H from the first knitted layer 20 in a direction away from the second knitted layer 22. In the present disclosure, the term "infrared transparent yarns" means yarns that allow infrared radiation to pass through. As a consequence, heat absorbed by the middle layer yarns 28 can easily be transferred from the first knitted layer 20 in a direction away from the second knitted layer 22. In certain embodiments, the first knitted layer 20 solely includes infrared transparent yarns to provide a purely radiative heating surface, thereby enhancing comfort in, for example, vehicle seats. As a non-limiting example, infrared transparent yarns include synthetic polymer fibers with an intrinsically low IR absorptance, such as polyethylene-based yarns. As discussed above, the first knitted layer 20 may (alternatively or additionally) include a plurality of infrared absorbing yarns to emanate heat H from the first knitted layer 20 in a direction away from the second knitted layer 22. In the present disclosure, the term "infrared absorbing yarn" means yarns capable of absorbing infrared radiation to raise the temperature of the first knitted layer 20. As a non-limiting example, the infrared absorbing yarn may include polymeric fibers which may be coated with infrared-absorbing pigment, such as carbon black or a chitin resin. In certain embodiments, the first knitted layer 20 may be solely made of infrared absorbing yarn for providing a heated surface, which may maximize the efficiency of HVAC packaging. Alternatively, the first knitted layer 20 includes a plurality of infrared transparent yarns and a plurality of infrared absorbing yarns by defining a porosity on the first knitted layer, thereby allowing the knitted fabric 12 to provide a heated surface and radiate heat H from the first knitted layer 20.

Figure 3:
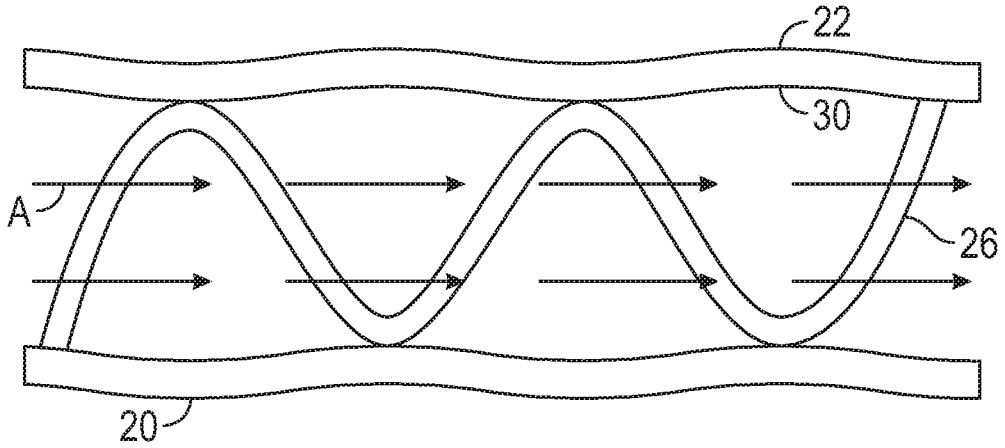
FIG. 3 is a schematic fragmentary cross-sectional view of the knitted structure shown in FIG. 1.

With reference to FIG. 3, the knitted structure 10 defines a gap between the first knitted layer 20 and the second knitted layer 22 to allow air A to flow through the gap 30 defined between the first knitted layer 20 and the second knitted layer 22. As a consequence, the air A flowing through the gap 30 can be heated, thereby maximizing the efficiency, for example, of an HVAC system.

Figure 4:
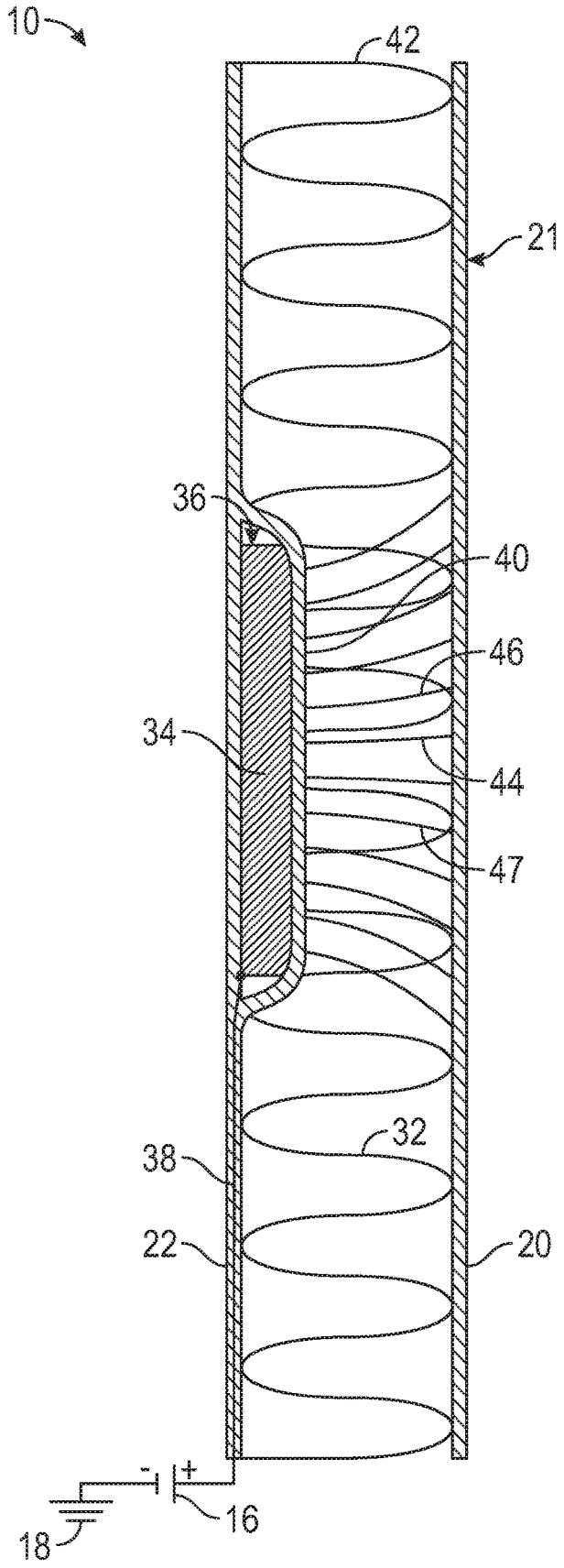
FIG. 4 is a schematic cross-sectional side view of the knitted structure of FIG. 1 including a pocket for a thermoelectric device.
Figure 5:
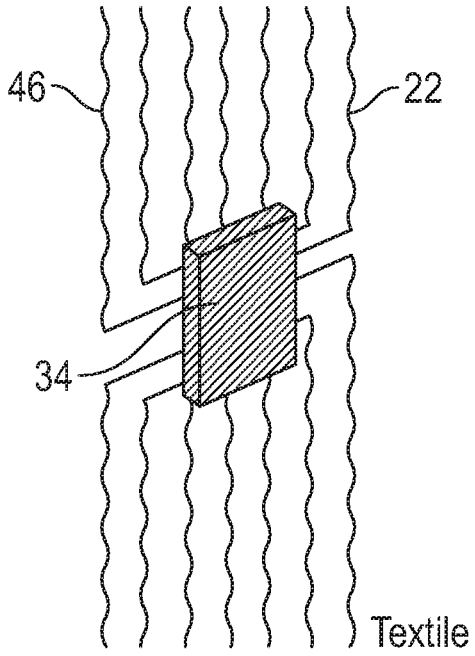
FIG. 5 is a schematic illustration of a first knitted layer of the knitted structure of FIG. 4.
Figure 6:
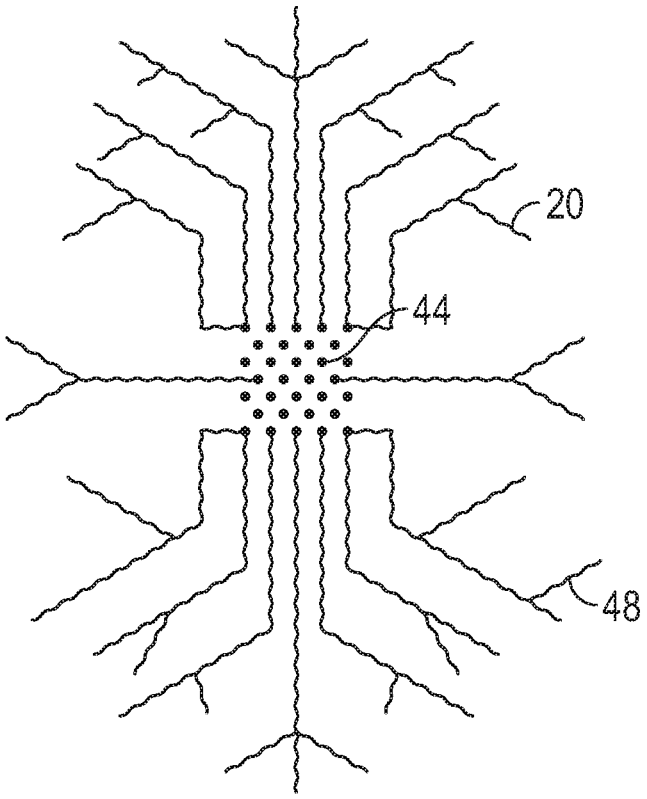
FIG. 6 is a schematic illustration of a second knitted layer of the knitted structure of FIG. 4.

With reference to FIGS. 4-6, the multi-bed knitted structure 10 includes a first knitted layer 20, a second knitted layer 22, and a knitted spacer fabric 32 interconnecting the first knitted layer 20 and the second knitted layer 22. As shown in FIG. 5, the second knitted layer 22 may be configured as a thermally-conductive yarn fin network 46. A similar thermally conductive network can be knitted into the second knitted layer 11 to service the opposite side of the thermoelectric device, so each side of the thermoelectric device has an efficient heat sink structure. The thermally-conductive yarn fin network 46 can maximize the heat transfer rate into or out of the second knitted layer 22. The second knitted layer 22 can be knitted on a first bed of needles. The first knitted layer 20 functions as a heat sink layer to provide heat to, for example, a vehicle seat. As shown in FIG. 6, the first knitted layer 20 can be knitted on a second bed of needles to form a web 48 of thermally-conductive yarns to interface with the occupant (e.g., seated occupant in direct contact with the first knitted layer 20).

The knitted spacer fabric 32 resiliently biases the first knitted fabric layer and the second knitted fabric layer away from one another. One or more thermoelectric devices 34 are disposed inside the multi-bed knitted structure 10. In the present disclosure, the term "thermoelectric device" means a device that employs the Peltier effect to directly convert electric voltage to a temperature differential and vice versa. In the present embodiment, the knitted structure 10 defines a pocket 36 shaped and sized to receive the thermoelectric device 34. Specifically, the multi-bed knitted structure 10 provides integrated locating and retaining features (i.e., the pocket 36) for the thermoelectric device 34. The multi-bed knitted structure 10 allows for the thermoelectric device 34 (which is rigid) to be isolated from harsh contact with an object or persons (i.e., occupants) that are in direct contact with the first knitted layer 20. One or more power leads 38 are electrically connected to the thermoelectric device 34 and electrical power supply 16. The electrical power supply 16 is connected to ground 18. The power leads 38 are knitted-in or inlayed in the second knitted layer 22. The thermoelectric device 34 can receive electric voltage from the electrical power supply 16 through the power leads 38. Thus, the power leads 38 are disposed inside the second knitted layer 22 and are electrically connected to one face of the thermoelectric device 34 to supply electricity to the thermoelectric device 34. Upon receipt of electric voltage from the power supply 16, the thermoelectric device 34 generates heat. Accordingly, the thermoelectric device 34 is configured to convert electrical energy directly into a temperature differential. The thermoelectric device 34 can also be used to cool a surface.

With continuing reference to FIGS. 4-6, to avoid harsh physical or thermal contact with an object or persons (i.e., occupants) that are in direct contact with the first knitted layer 20, the thermoelectric device 34 is closer to the second knitted layer 22 than to the first knitted layer 20. Specifically, the thermoelectric device 34 may be entirely disposed inside the pocket 36 to properly retain and locate it relative to the desired heated surface (i.e., the outer surface 21 of the first knitted layer 20). In a vehicle seat, the outer surface 21 of the first knitted layer 20 is the surface facing the seated occupant. The pocket 36 is partly defined by the second knitted layer 22 and an overlying knitted layer 40 directly connected to the second knitted layer 22 in order to retain the thermoelectric device 34 in a desired location. The overlying knitted layer 40 is in direct contact with the thermoelectric device 34 to facilitate heat transfer between the thermoelectric device 34 and the overlying knitted layer 40. The thermoelectric device can also be run in an opposite mode, cooling the first knitted layer 20 while heating the second knitted layer 22.

With continuing reference to FIGS. 4-7, the knitted spacer fabric 32 includes a plurality of non-thermally conductive yarns 42. Further, the knitted spacer fabric 32 includes a heat-conductive yarn network 44 (see also FIG. 6) directly interconnecting one side the pocket 36/face of the TE device 36 (specifically the overlying knitted layer 40) and the first knitted layer 20 to transfer heat to or from the thermoelectric device 34 to the first knitted layer 20. To do so, the heat-conductive yarn network 44 includes thermally-conductive yarns 47 directly interconnecting the overlying knitted layer 40 (which partially defines the pocket 36). In the present disclosure, the term "thermally-conductive yarns" means yarns that can (and in fact facilitate) heat transfer. Thus, the thermally-conductive yarns 47 thermally couple the thermoelectric device 34 to the first knitted layer 20. The first knitted layer 20 and the second knitted layer 22 are not in physical contact with one another. Further, the first knitted layer 20 and the second knitted layer 22 are not in electrical contact with one another to avoid a short-circuit.

Figure 7:
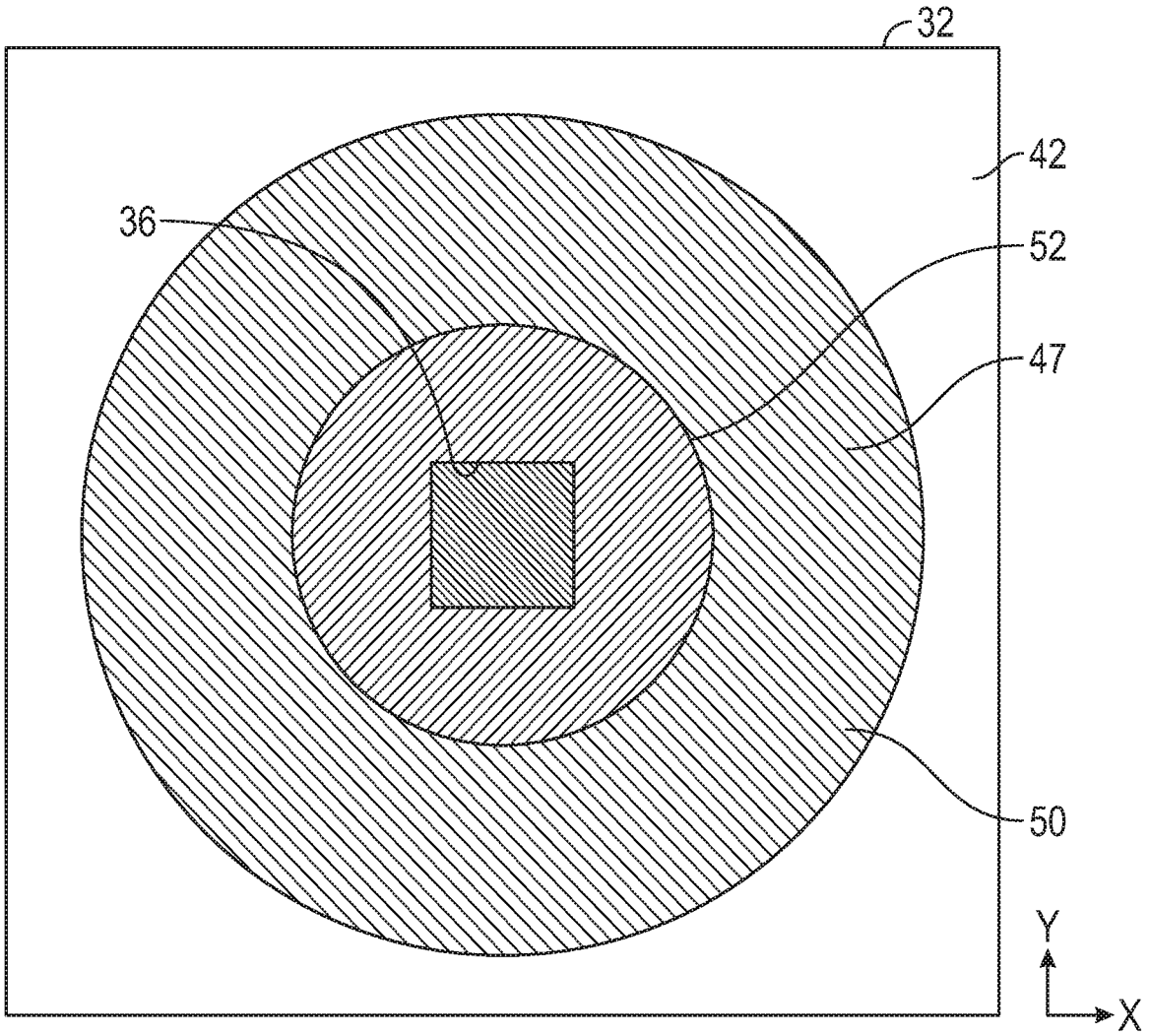
FIG. 7 is a schematic illustration of a knitted spacer fabric of the knitted structure of FIG. 4.
Figure 8:
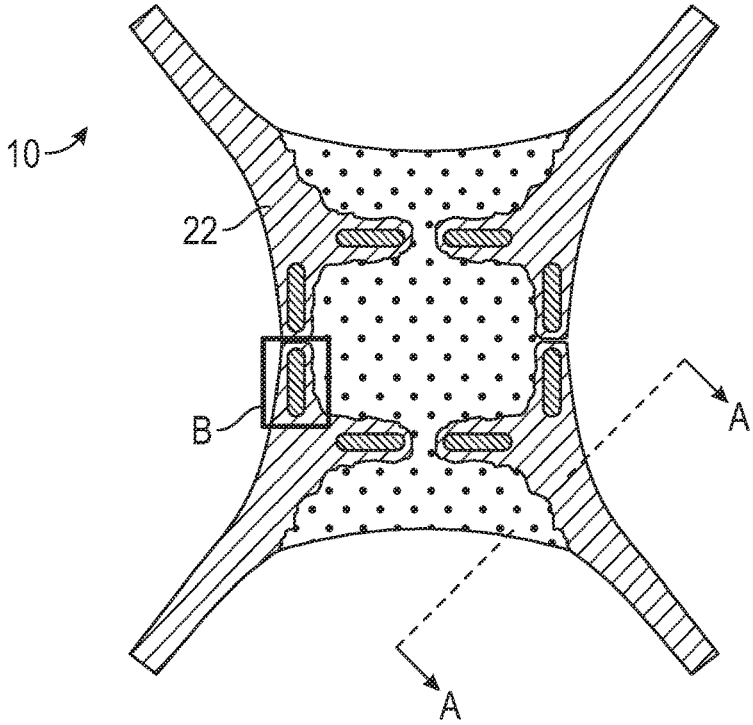
FIG. 8 is a schematic illustration of a knitted structure defining integrated knitted ducts.
Figure 9:
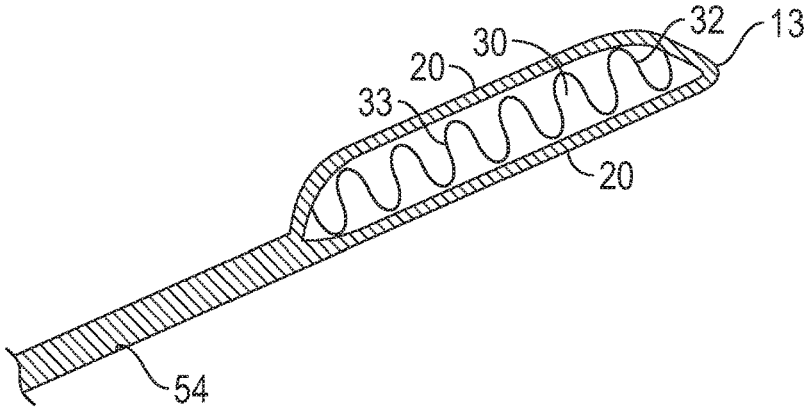
FIG. 9 is a schematic sectional view of the knitted structure of FIG. 8, taken along section line A-A.
Figure 10:
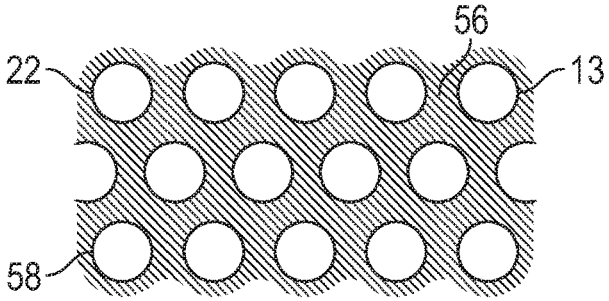
FIG. 10 is a schematic fragmentary, enlarged view of the knitted structure of FIG. 8, taken around area B.

With reference to FIG. 7, the knitted spacer fabric 32 may be a polyester swatch and includes thermally-conductive yarns 47 and non-thermally conductive yarns 42 surrounding the thermally-conductive yarns 47 to maximize the heat transfer rate from the thermoelectric device 34 (FIG. 4) to the first knitted layer 20. The thermally-conductive yarns 47 can be arranged in a first yarn field 50 and a second yarn field 52. The density of the thermally-conductive yarns 47 in the second yarn field 52 is greater than the density of the thermally-conductive yarns 47 in the first yarn field 50 to maximize the heat transfer rate from the thermoelectric device 34 (FIG. 4) to the first knitted layer 20. Further, the first yarn field 50 surrounds the second yarn field 52 to maximize the heat transfer rate from the thermoelectric device 34 (FIG. 4) to the first knitted layer 20. The thermally-conductive yarns 47 in the first yarn field 50 are sparsely arranged but directly connected to each other along the X direction and the Y direction. The second yarn field 52 may surround the pocket 36.

Figure 11:
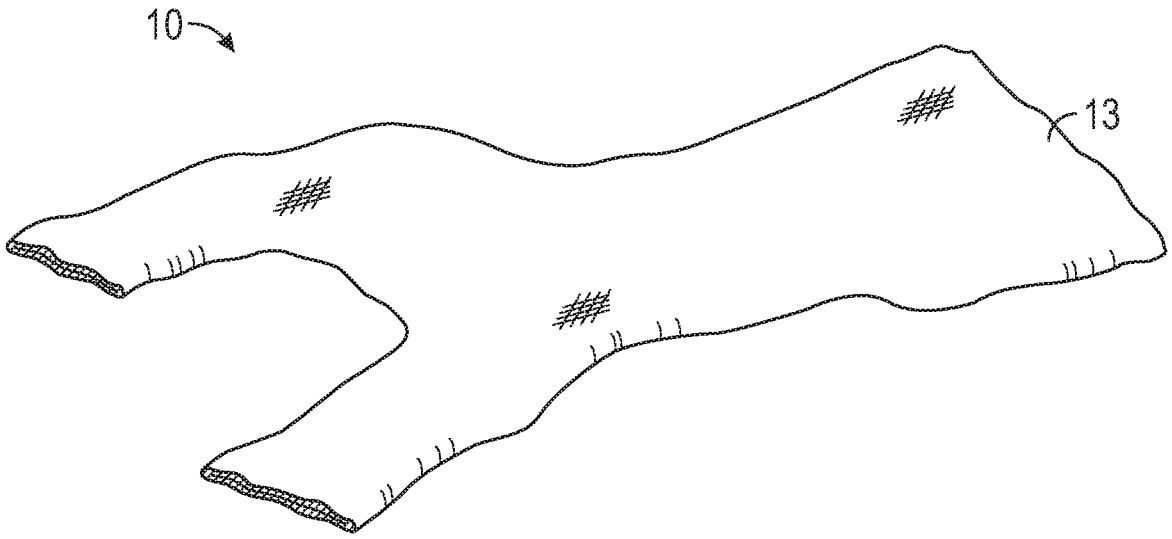
FIG. 11 is a schematic isometric view of the knitted structure of FIG. 8, shown flat for shipping.
Figure 12:
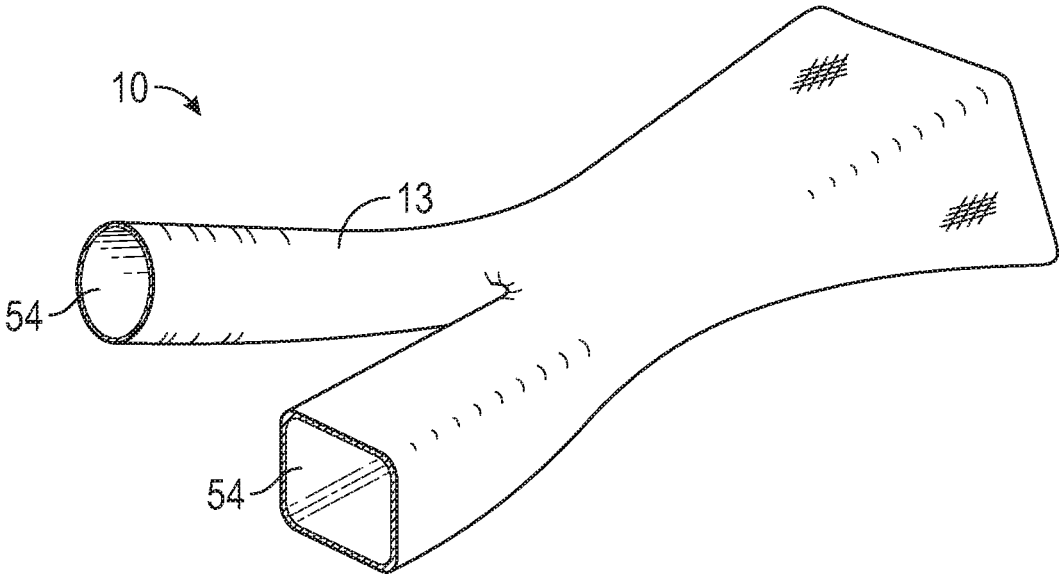
FIG. 12 is a schematic isometric view of the knitted structure of FIG. 8, shown expanded for installation and/or use.

With reference to FIGS. 8-12, the multi-bed knitted structure 10 can define integrated knitted ducts 54 for HVAC and aero applications. The multi-bed knitted structure 10 can also be used for brake ducting and other applications requiring directed airflow delivery. No special tooling is needed to produce the knitted structure 10. Rather, a single knitting machine could produce the knitted structure 10 with many geometries. Further, the knitted structure 10 could be knitted in one-piece, even for complex, branching, and/or overlapping geometries. The knitted structure 10 includes a knitted body 13 including a first knitted layer 20 and a second knitted layer 22. The knitted body 13 defines one or more integrated knitted ducts 54 between the first knitted layer 20 and the second knitted layer 22 to allow fluid flow through the knitted body 13. As shown in FIG. 11 the knitted body 13 is configured to be flat for shipping and then (as shown in FIG. 12), can be expanded for installation and/or use, thereby allowing flexible and efficient manufacturing. The knitted body 13 is wholly or partly made of fusible yarns 33 to fix the desired shape of the knitted body 13 after it has been expanded (FIG. 12). To expand, the knitted body 13 is inflated through the integrated knitted ducts 54 and steamed in order to fix the shape of the fusible yarns 33. As a consequence, the fusible yarns 33 bond and rigidize. The fusible yarns 33 also prevent seal surface leakage. The fusible yarns 33 may be wholly or partly made of low-melt polyamide or co-polyester. The knitted body 13 can be integrated in the trim of a vehicle, such as the headliner.

The knitted structure 10 may include a knitted spacer fabric 32. A gap is defined through the knitted spacer fabric 32 between the first knitted layer 20 and the second knitted layer 22 to allow fluid flow through the gap 30. Insulation may be knitted into the knitted body 13. The knitted body 13 may define mesh knitted outlets 56 extending through the second knitted layer 22. The mesh knitted outlets 56 can deliver fluid (e.g., air) to target locations. In addition, the knitted body 13 may define thru-holes 58 extending through the mesh of the mesh knitted outlets 56.

While the best modes for carrying out the teachings have been described in detail, those familiar with the art to which this disclosure relates will recognize various alternative designs and embodiments for practicing the teachings within the scope of the appended claims. The knitted structures illustratively disclosed herein may be suitably practiced in the absence of any element which is not specifically disclosed herein. Furthermore, the embodiments shown in the drawings or the characteristics of various embodiments mentioned in the present description are not necessarily to be understood as embodiments independent of each other. Rather, it is possible that each of the characteristics described in one of the examples of an embodiment can be combined with one or a plurality of other desired characteristics from other embodiments, resulting in other embodiments not described in words or by reference to the drawings. For example, all or some of the features of the knitted structure 10 described in FIGS. 1-3 can be combined with all or all the features of the knitted structure 10 described in FIGS. 4-7 and/or all or some of the features of the knitted structure 10 described in FIGS. 8-12.

The invention claimed is:

1. A knitted structure for heat generation and distribution, comprising:

a knitted fabric including a first knitted layer and a second knitted layer opposite the first knitted layer, wherein the first knitted layer has a first thermal conductivity, the second knitted layer has a second thermal conductivity, and the second thermal conductivity is greater than the first thermal conductivity to facilitate heat transfer toward the first knitted layer;

a plurality of electrodes at least partially disposed inside the knitted fabric, wherein each of the plurality of electrodes is configured to generate heat within the knitted fabric upon receipt of electrical energy in order to distribute heat along the knitted structure and toward the first knitted layer; and wherein the first knitted layer includes a plurality of infrared transparent yarns and a plurality of infrared absorbing yarns to define a porosity on the first knitted layer.

2. The knitted structure of claim 1, wherein the second knitted layer includes a plurality of heat-insulating yarns.

3. The knitted structure of claim 1, wherein the second knitted layer includes a plurality of infrared reflective yarns.

4. The knitted structure of claim 1, further comprising a middle knitted layer disposed between the first knitted layer and the second knitted layer, wherein the middle knitted layer includes a plurality of resistive heating yarns to facilitate heat transfer toward the first knitted layer.

5. The knitted structure of claim 1, further comprising a middle knitted layer disposed between the first knitted layer and the second knitted layer, wherein the middle knitted layer includes a plurality of infrared producing yarns to facilitate heat transfer toward the first knitted layer.

6. The knitted structure of claim 1, wherein the first knitted layer includes the plurality of infrared transparent yarns to provide a heated surface.

7. The knitted structure of claim 1, wherein the first knitted layer includes the plurality of infrared transparent yarns to provide a purely radiative heating surface.

* * * * *